United States Patent [19]

Gladden

[11] Patent Number: 4,602,556

[45] Date of Patent: Jul. 29, 1986

[54] AIR DEFLECTOR

[76] Inventor: Marguerite M. Gladden, 8124 Kimbrook Dr., Germantown, Tenn. 38138

[21] Appl. No.: 692,344

[22] Filed: Jan. 16, 1985

Related U.S. Application Data

[63] Continuation-in-part of Ser. No. 447,306, Jan. 20, 1983, abandoned.

[51] Int. Cl.[4] ..... F24F 13/08

[52] U.S. Cl. ..... 98/103; 98/108

[58] Field of Search ..... 98/40.19, 101, 103, 98/105, 108, 109; D23/138

[56] References Cited

U.S. PATENT DOCUMENTS

| | | | |
|---|---|---|---|
| D. 30,050 | 1/1899 | Tracy | D23/138 |
| 1,571,631 | 2/1926 | Krueger | 98/103 |
| 1,703,567 | 2/1929 | Behringer | 98/109 |
| 2,080,726 | 5/1937 | Lowinger | 98/108 X |
| 2,249,308 | 7/1941 | Bedol | 98/103 X |
| 2,909,983 | 10/1959 | Scheck et al. | 98/101 |

*Primary Examiner*—Harold Joyce

*Attorney, Agent, or Firm*—Walker & McKenzie

[57] ABSTRACT

An air deflector for use with an air exhaust grill to deflect the air being discharged therethrough. The deflector includes an elongated plate member having first and second ends and a tab member attached to the first end of the plate member and clamped between the air exhaust grill and the supporting surface to position the plate member so as to deflect the air being exhausted through the air exhaust grill toward the second end of the plate member.

7 Claims, 9 Drawing Figures

AIR DEFLECTOR

CROSS-REFERENCE TO RELATED APPLICATION

This is a continuation-in-part to my application, Ser. No. 447,306, filed Jan. 20, 1983 now abandoned, entitled "Vent-Hood Deflector".

BACKGROUND OF THE INVENTION

1. Field of the Invention

The present invention relates, in general, to means for controlling the flow of forced air from an air exhaust grill of an air conditioning system having a forced air supply.

2. Description of the Prior Art

A typical forced air type air conditioning system includes a number of forced air supply ducts that extend from a central heating/cooling unit to various supporting surfaces, such as the walls or ceilings of rooms to be cooled or heated. Various types of air exhaust grills or registers are commonly attached to the support surface adjacent the distal end of each air supply duct. Such air exhaust grills may include a plurality of apertures therethrough for allowing air to be forced therethrough, filters for filtering the air being forced therethrough, and/or adjustable valve mechanisms for adjusting the flow of air therethrough. The apertures are typically angled so as to provide wide-spread distribution of the air being forced therethrough. Various heat deflectors and the like for ventilation units and hot air registers have heretofore been designed. See, Tracy, U.S. Pat. No. D 30,059 and Efstratis, U.S. Pat. No. D 271,900. Neither of the above designs disclose or suggest the present invention.

SUMMARY OF THE INVENTION

The present invention is directed toward providing a means for being easily attached relative to an air exhaust grill of a forced air type air conditioning system and for controlling or directing the flow of air from the grill. The concept of the present invention is to provide a tab member for being clamped between one edge of the grill and the supporting surface to which the grill is attached, and an elongated plate member having one end attached to the tab member so as to position the body of the plate member at an angle relative to the air exhaust grill and so as to deflect the air being exhausted through the air exhaust grill toward the direction which the plate member is angled.

DESCRIPTION OF THE PREFERRED EMBODIMENT

Figure 1:
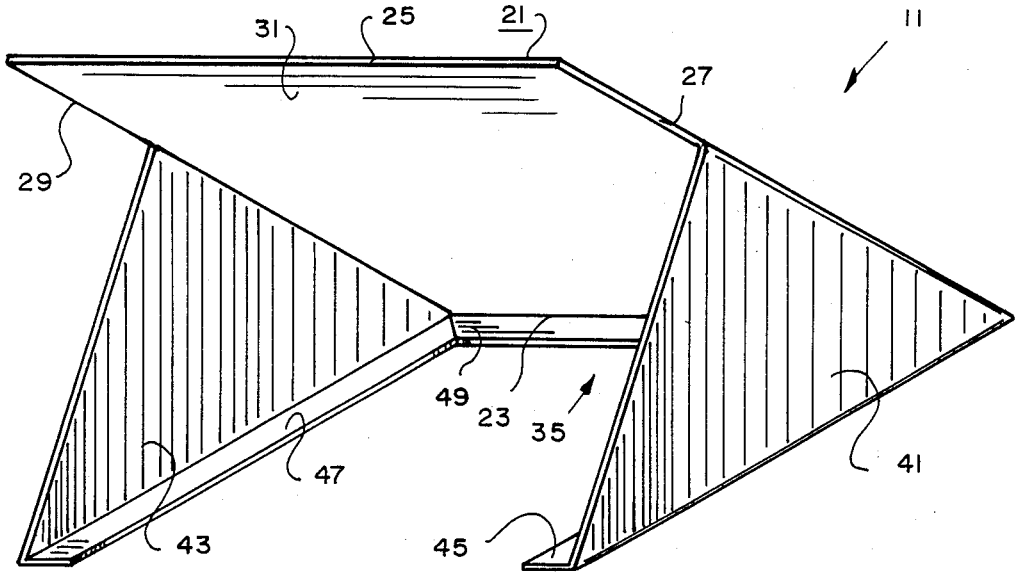
FIG. 1 is a perspective view of the air deflector of the present invention.
Figure 2:
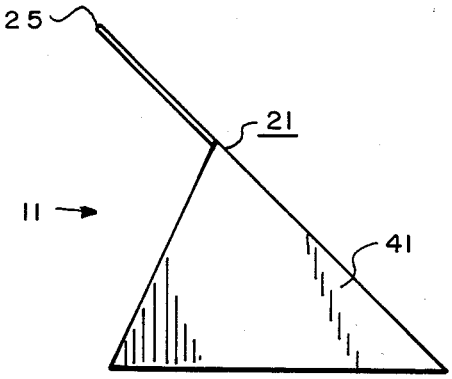
FIG. 2 is a side elevational view of the air deflector of the present invention.
Figure 3:
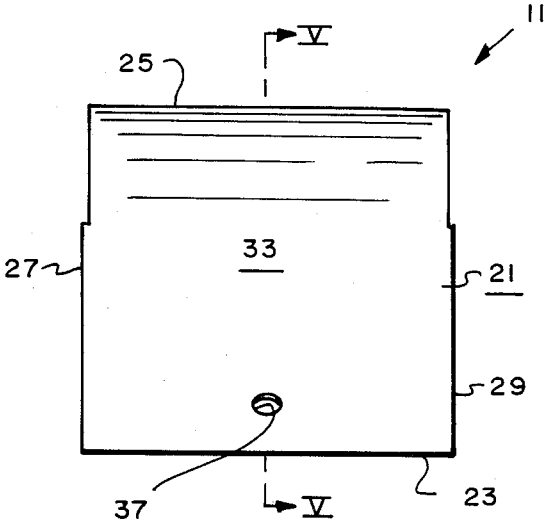
FIG. 3 is a right end elevational view of FIG. 2
Figure 4:
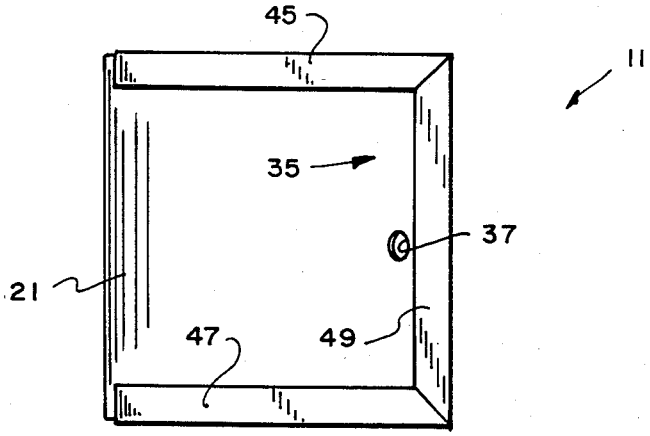
FIG. 4 is a bottom plan view of FIG. 2.
Figure 5:
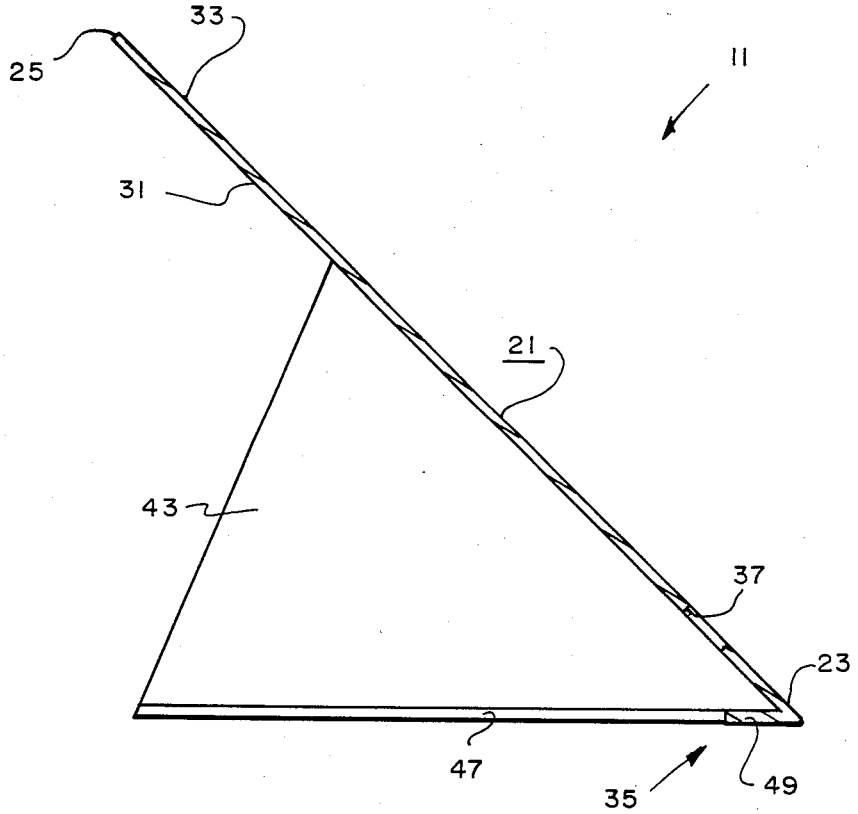
FIG. 5 is an enlarged sectional view substantially as taken on line V—V of FIG. 3.

The air deflector 11 of the present invention is for use with an air exhaust grill 13 attached to a supporting surface, such as a wall 15 or the like, by at least one screw 17. The air exhaust grill 13 is typically a component of an air conditioning system having a force air supply for blowing conditioned air (either heated, cooled, or simply unheated or uncooled air) into a room, or the like, through the air exhaust grill 13. Such an air exhaust grill 13 may have a substantially rectangular facade to cover the outlet end of an air exhaust duct 19 and attached to the wall 15 by a pair of screws 17 located one at either end thereof.

The air deflector 11 includes an elongated plate member 21 having a first end 23, a second end 25, a first side 27, a second side 29, a first face 31, and a second face 33. The plate member 21 is preferably constructed of a substantially rigid, flat material, such as sheet aluminum, or the like.

The air deflector 11 includes a tab means or member 35 attached to the first end 23 of the plate member 21 and clamped between the air exhaust grill 13 and the supporting surface or wall 15 for positioning the first face 31 of the plate member 21 relative to the air exhaust grill 13 so as to deflect the air being exhausted through the air exhaust grill 13 toward the second end 25 of the plate member 21.

The plate member 21 preferably has an aperture 37 therethrough for allowing access to at least one of the screws 17 holding or attaching the air exhaust grill 13 to the supporting surface or wall 15 so that the screw 17 can be loosened, the tab member 35 slipped between the air exhaust grill 13 and the wall 15, and access can then be had through the aperture 37 with a screwdriver 39, or the like, to allow the screw 17 to be retightened, thereby securing the air deflector 11 relative to the air exhaust grill 13. The aperture 37 is preferably located substantially adjacent the first end 23 of the plate member 21.

The air deflector 11 preferably includes a first side member 41 extending from the first side 27 of the plate member 21 and a second side member 43 extending from the second side 29 of the plate member 21. The first and second side members 41, 43 coact with the plate member 21 when the air deflector 11 is mounted relative to the air exhaust grill 13 to direct the air toward the second end 25 of the plate member 21 as will now be apparent to those skilled in the art. The first and second side members 41, 43 preferably extend from the first end 23 of the plate member 21 to a point substantially midway or so between the first and second ends 23, 25 of the plate member 21. The first and second side members 41, 43 are also preferably constructed of substantially rigid, flat material, such as sheet aluminum or the like.

The tab member 35 preferably includes a first side portion 45 for extending inwardly from the first side member 41, a second side portion 47 for extending inwardly from the second side member 43, and an end portion 49 for extending inwardly from the first end 23 of the plate member 21 whereby the air deflector 11 can be slid between the air exhaust grill 13 and wall 15 after the screw 17 has been loosened to position the first and second side portions 47, 49 and end portion 49 of the tab member 37 between the air exhaust grill 13 and wall 15 so that the air deflector 11 will be securely held relative to the air exhaust grill 13 upon subsequent retightening of the screw 17. Each portion 45, 47, 49 of the tab member 35 is preferably also constructed of a substantially rigid, flat material such as sheet aluminum or the like.

The plate member 21 preferably extends at an angle relative to the wall 15 to direct the air being exhausted through the air exhaust grill 13 at an angle relative to the wall 15. More specifically, the plate member 21 preferably extends at an angle of 45° relative to the wall 15.

Figure 6:
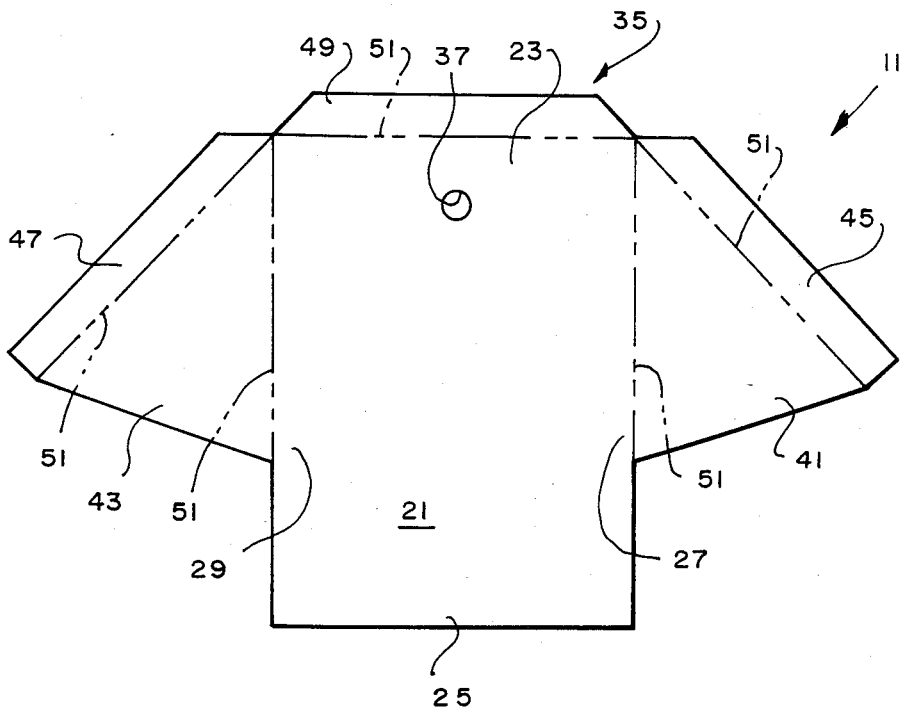
FIG. 6 is a plan view of a blank from which the air deflector of the present invention may be formed.
Figure 7:
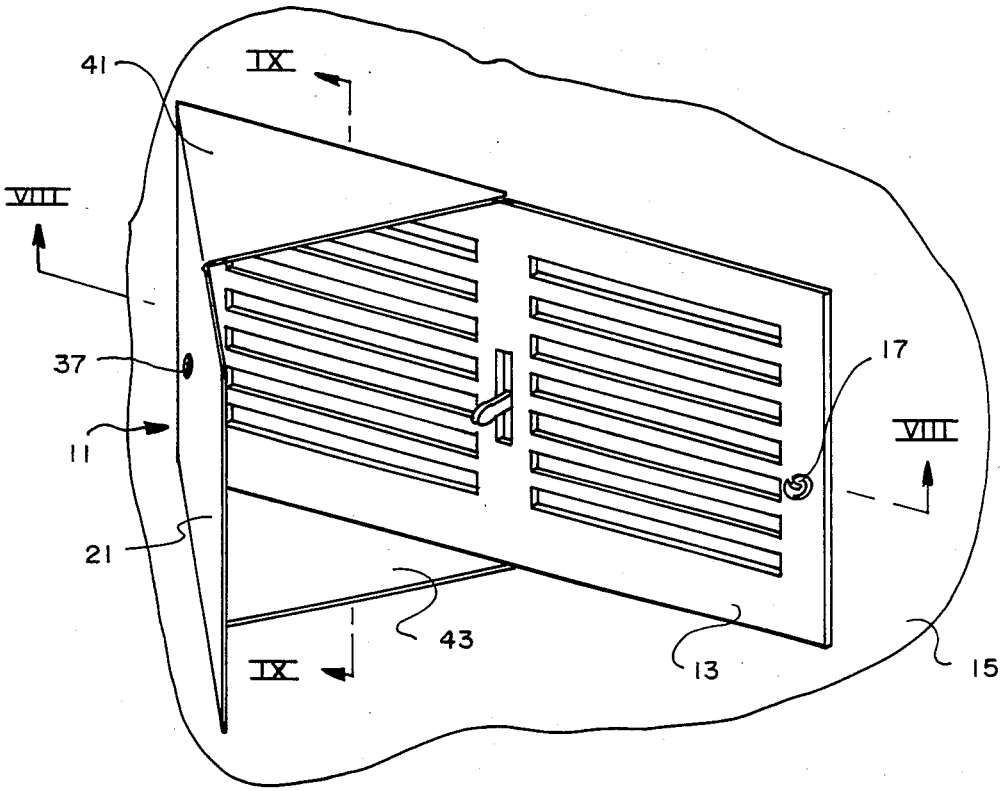
FIG. 7 is a perspective view of the air deflector of the present invention shown associated with an air exhaust grill and a supporting surface.
Figure 8:
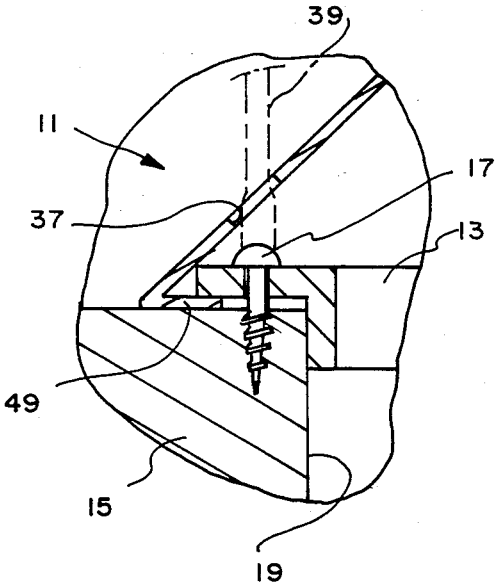
FIG. 8 is an enlarged sectional view substantially as taken on line VIII—VIII of FIG. 7 with portions thereof broken away for clarity and with a screwdriver or similar tool shown in broken lines.
Figure 9:
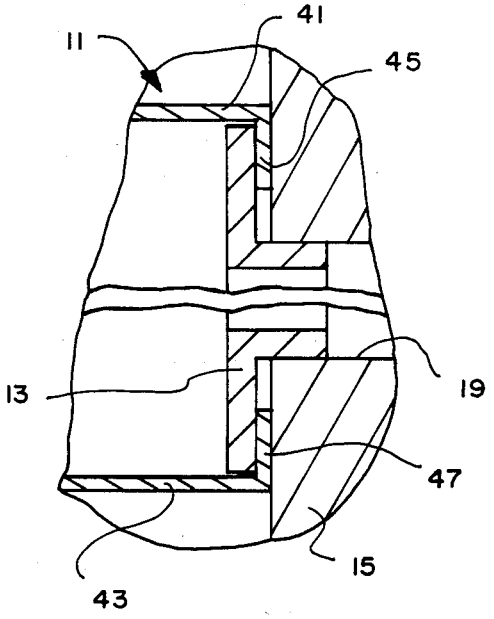
FIG. 9 is an enlarged sectional view substantially as taken on line IX—IX of FIG. 7 with portions thereof broken away for clarity.

The plate member 21, tab member 35, first side member 41 and second side member 43 are preferably constructed out of a single, unitary blank of sheet aluminum as shown in FIG. 6. Appropriate score lines as at 51 (see FIG. 6) are preferably provided on the blank to separate the various members and to allow the air deflector 11 to be easily folded from the blank as will now be apparent to those skilled in the art.

The air deflector 11 may be constructed in various sizes and shapes for use with various specific air exhaust grills 13 and to direct or deflect the air in various specific directions. The air deflector 11 may be painted to match the decor of the room or may be painted flat white, etc.

As thus constructed and used, the present invention provides an air deflector for use with an air exhaust grill, or the like, to direct the conditioned air being exhausted therefrom from blowing on the occupant of a room. The tongue-like tab member 35 of the air deflector 11, in combination with the access aperture 37 through the plate member 21, allows the air deflector 11 to be easily mounted relative to an air exhaust grill 13 on either end thereof without requiring the air exhaust grill 13 to be removed from the wall 15, or the like.

Although the present invention has been described and illustrated with respect to a preferred embodiment thereof and preferred use therefore, it is not to be so limited since changes and modifications can be made therein which are within the full intended scope of the invention.

I claim:

1. An air deflector for use with an air exhaust grill attached to a supporting surface by at least one screw, said air deflector comprising:

(a) an elongated plate member having first and second ends, first and second sides and first and second faces;

(b) a tab means attached to said first end of said plate member for being clamped between said air exhaust grill and said supporting surface for positioning said first face of said plate member relative to said air exhaust grill so as to deflect the air being exhausted through said air exhaust grill toward said second end of said plate member; said plate member having an aperture therethrough for allowing access to said at least one screw attaching said air exhaust grill to said supporting surface so that said at least one screw can be loosened, said tab member slipped between said air exhaust grill and said supporting surface, and access can then be had through said aperture in said plate member to retighten said at least one screw.

2. The air deflector of claim 1 in which is included a first side member extending from said first side of said plate member and a second side member extending from said second side of said plate member.

3. The air deflector of claim 2 in which said first and second side members extend from said first end of said plate member to a point substantially midway between said first and second ends of said plate member.

4. The air deflector of claim 2 in which said tab member includes a first side portion extending inwardly from said first side member, a second side portion extending inwardly from said second side member, and an end portion extending inwardly from said first end of said plate member.

5. The air deflector of claim 4 in which said plate member, said tab member and said first and second side members are folded out of a single, unitary blank of sheet aluminum.

6. The air deflector of claim 2 in which said plate member extends at an angle of 45° relative to said supporting surface.

7. The air deflector of claim 2 in which said aperture through said plate member is located substantially adjacent said first end thereof.

* * * * *